United States Patent [19]

Kawamura et al.

[11] Patent Number: 4,747,795

[45] Date of Patent: May 31, 1988

[54] OUTBOARD ENGINE CONSTRUCTION ADAPTED FOR USE WITH DEEP DRAFT AND SHALLOW DRAFT VESSELS

[75] Inventors: Hiroshi Kawamura; Nobuo Haga; Sukehiro Yamaguchi, all of Wako, Japan

[73] Assignee: Honda Giken Kogyo Kabushiki Kaisha, Tokyo, Japan

[21] Appl. No.: 15,216

[22] Filed: Feb. 17, 1987

[30] Foreign Application Priority Data

Feb. 17, 1986 [JP] Japan ..... 61-32637

[51] Int. Cl.[4] ..... B63H 21/26

[52] U.S. Cl. ..... 440/75; 440/76; 440/900

[58] Field of Search ..... 74/369–372; 440/75, 76, 83, 64, 78, 900; 464/182

[56] References Cited

U.S. PATENT DOCUMENTS 1,910,561 5/1933 Pierce ..... 440/75
3,025,822 3/1962 Tenney ..... 440/75
3,487,803 1/1970 Alexander, Jr. ..... 440/75
4,343,612 8/1982 Blanchard ..... 440/75

FOREIGN PATENT DOCUMENTS 2588885 2/1985 Japan .

*Primary Examiner*—Joseph F. Peters, Jr.
*Assistant Examiner*—Edwin L. Swinehart
*Attorney, Agent, or Firm*—Roberts, Spiecens & Cohen

[57] ABSTRACT

An outboard engine construction in which an engine is mounted at the upper end of an extension case provided with a stern bracket adapted to be clamped to a stern plate of a vessel and a gear case having a rotatable propeller is connected to the lower end of the extension case. A drive shaft connected to a crank shaft of the engine is housed within the extension case and a drives a gear assembly connected to the propeller. The extension case is constituted by a primary upper case portion and a selectively removable auxiliary lower case portion. A transmission is contained in the auxiliary case portion and is detachably interposed therewith between the drive shaft and the gear assembly.

25 Claims, 4 Drawing Sheets

OUTBOARD ENGINE CONSTRUCTION ADAPTED FOR USE WITH DEEP DRAFT AND SHALLOW DRAFT VESSELS

FIELD OF THE INVENTION

The present invention relates to improvements in an outboard engine construction comprising an engine mounted on the upper end of an extension case provided with a stern bracket adapted to be clamped to a stern plate, a gear case rotatably supporting a propeller and connected to the lower end of the extension case, a drive shaft connected to a crank shaft of the engine and housed within the extension case and a gear assembly in the gear case operatively connecting the drive shaft to the propeller.

DESCRIPTION OF THE PRIOR ART

In general, in such an outboard engine construction, extension cases of different lengths and gear assemblies having different gear ratios are provided for each application thereof. More specifically, a relatively long extension case and a gear assembly having a relatively large step down speed ratio are employed for an outboard engine destined for ships of deep draft, such as normal fishing boats or the like, while a relatively short extention case and a gear assembly having a relatively small step down speed ratio are employed for an outboard engine for ships of shallow draft, such as motorboats, rubber boats or the like.

The preparation of an extension case and a gear assembly for each application of an outboard engine as described above is not desirable in mass prodrction and not only leads to a reduction in production efficiency but also an increase in cost.

INFORMATION DISCLOSURE STATEMENT

Japanese Patent Publication No. 25888/85 discloses a construction of an outboard engine in which extension cases of different length and number are selectively employed to change the overall length of the construction for use with various kinds of boats. However, different transmissions are required for each different length of the construction.

U.S. Pat. No. 3,025,822 discloses a construction of an outboard engine in which different gearing can be provided in a housing section to establish different drive ratios between the engine and the propeller.

SUMMARY OF THE INVENTION

An object of the present invention is to provide an outboard engine construction of the type as described above but which can be selectively employed for ships of deep and shallow drafts.

To achieve the above object, the invention provides that the extension case is constituted of a primary upper case portion and a removable auxiliary lower case portion detachably connected to the primary case portion and to the gear case. In a first configuration of the outboard engine construction in which the extension case is of maximum length, the lower case portion is connected between the upper case portion and the gear case whereas in a second configuration of the outboard engine construction in which the extension case is of reduced length the lower case portion is removed and the upper case portion is directly connected to the gear case. In further accordance with the invention, a transmission is contained in the auxiliary case portion and is coupled between the drive shaft and the gear assembly in the first configuration whereas in the second configuration the drive shaft is directly coupled to the gear assembly.

When the primary and auxiliary case portions are interconnected in the first configuration, the outboard engine includes the longer extension case and the range of speed of the propeller can be widened by the operation of the transmission contained within the auxiliary case portion. Therefore, this configuration of the outboard engine is suitable for ships of deep draft, such as normal fishing boats and the like.

On the other hand, if the auxiliary case portion is removed and the primary case portion is directly connected to the gear case in the second configuration, the extension case of the outboard engine is shorter and moreover, the drive shaft is directly connected to the gear assembly so that the propeller is rotated at a higher speed than when the transmission is engaged. Therefore, this outboard engine configuration is suitable for ships of shallow draft, such as motorboats and the like.

DETAILED DESCRIPTION OF A PREFERRED EMBODIMENT

Figure 1:
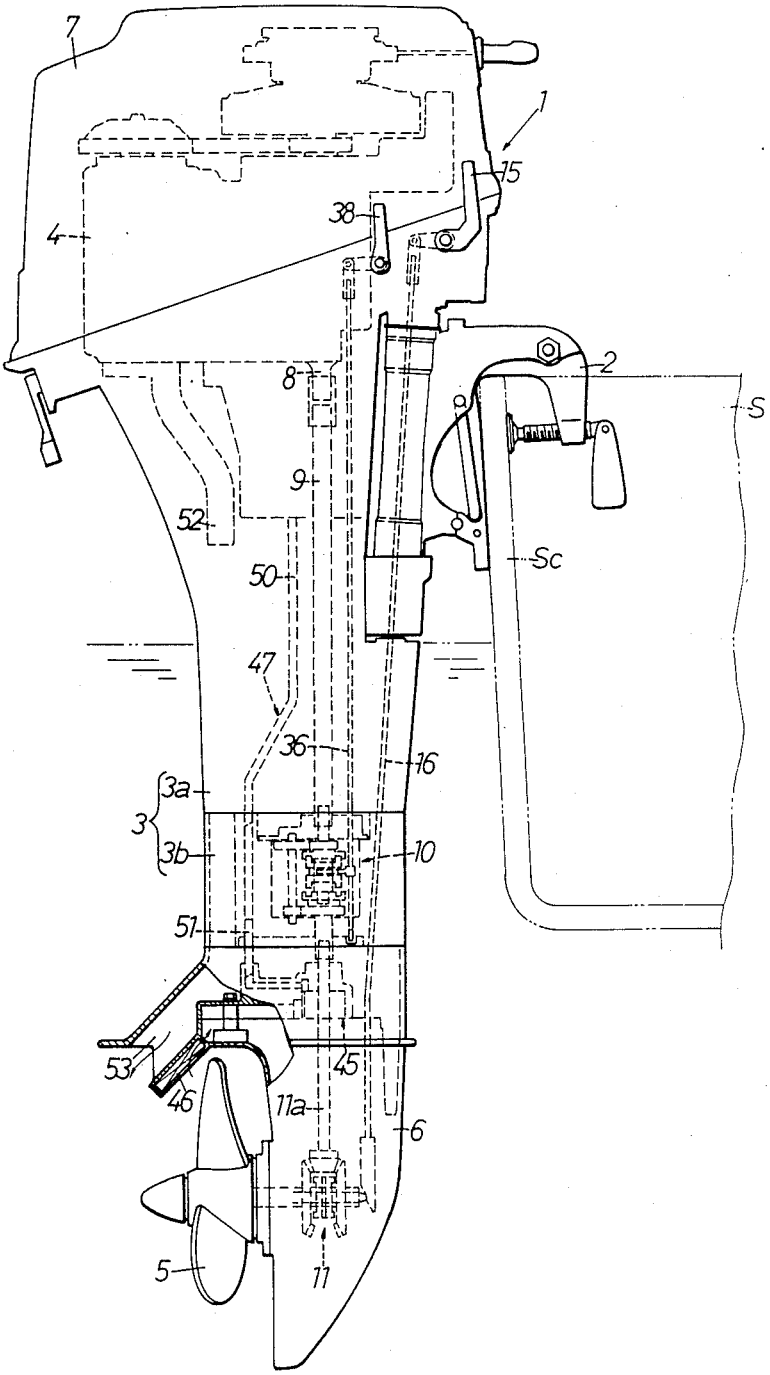
FIG. 1 is a side elevation view, partly broken away in section, of a first configuration of the outboard engine construction according to the present invention adapted for use on ships of deep draft.

The present invention will now be described with reference to the preferred embodiment illustrated in the accompanying drawing. Referring to FIG. 1, therein is shown an outboard engine construction 1 in a configuration suitable for use on a ship S of deep draft. The engine construction 1 includes an extension case 3 provided at its front portion with a stern bracket 2 clamped to a stern plate Sc of the ship S. The outboard engine construction includes an engine 4 mounted on the upper portion of the extension case 3, and a gear case 6 connected to the lower end of the extension case 3. A propeller 5 is rotatably supported on the rear wall of the gear case 6. The engine 4 is enclosed by an engine cover 7 mounted on the upper end of the extension case 3.

The engine 4 has a vertical crank shaft 8 which is operatively connected to the propeller 5 through a drive shaft 9 and a transmission 10 both disposed within the extension case 3 and through a gear assembly 11 which is housed in the gear case 6 to permit change-over between forward and reverse drive. The gear assembly 11 is operated to effect change-over between forward and reverse drive by a change-over lever 15 which operates a change rod 16. The lever 15 is pivotally supported near the top of the extension case 3.

Figure 4:
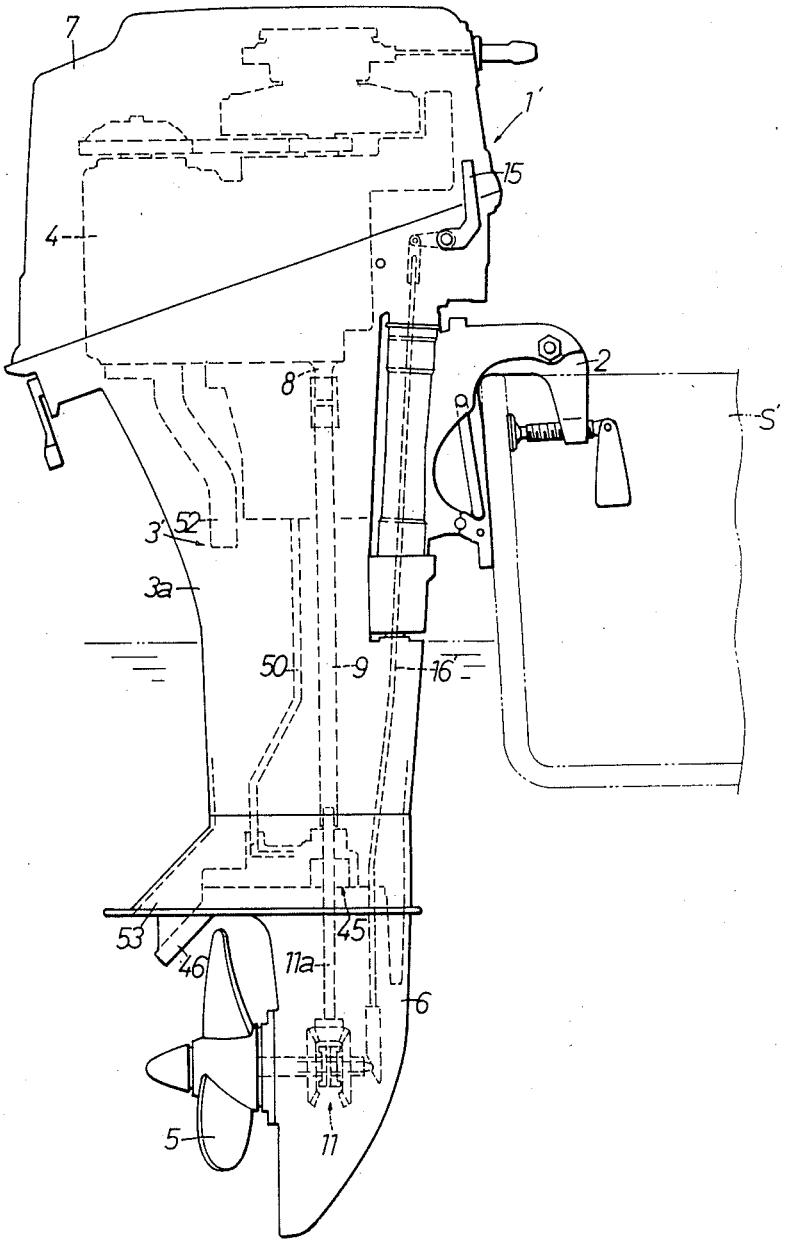
FIG. 4 is a side elevational view of the outboard engine modified according to a second configuration for use with ships of shallow draft.

The extension case 3 is constituted by a primary upper case portion 3*a* provided with the stern bracket 2 and an auxiliary lower case portion 3*b* detachably connected to the primary case portion 3*a* by suitable means, such as bolts or the like (not shown). The auxiliary case portion 3*b* is detachably connected to the gear case 6 also by suitable means, such as bolts or the like (not shown). The primary case portion 3*a* is also directly connectable to the gear case 6 (with the auxiliary case portion 3*b* omitted) in a second configuration of the outboard engine construction as shown in FIG. 4. The primary case portion 3*a* has a length corresponding to the length of an extension case 3' suitable for a shallow draft ship S' (FIG. 4). The total length of the primary case portion 3*a* plus the auxiliary case portion 3*b* corresponds to the length of the extension case suitable for the deep draft ship S.

The drive shaft 9 is spline-connected to the crank shaft 8 and is disposed within the primary case portion 3*a* to extend longitudinally therein and the transmission 10 connecting the drive shaft 9 to an input shaft 11*a* of the gear assembly 11 is housed within the auxiliary case portion 3*b*.

Figure 2:
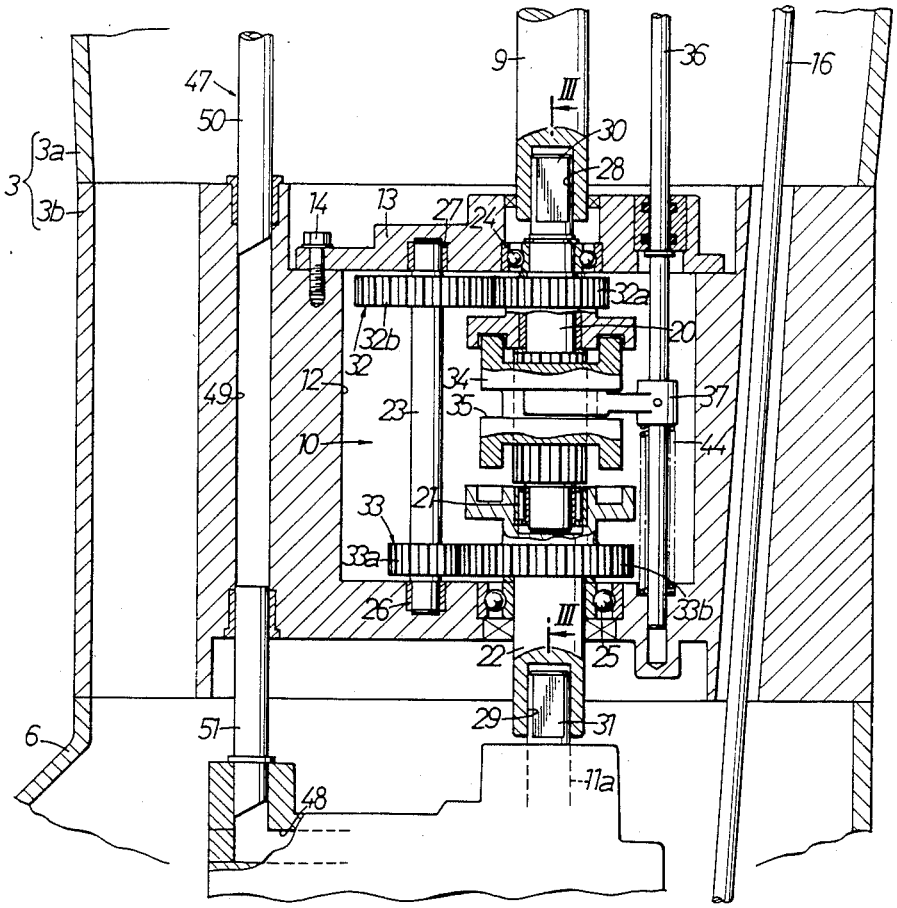
FIG. 2 is a vertical sectional view of an auxiliary case portion and associated parts of the outboard engine construction in FIG. 1.
Figure 3:
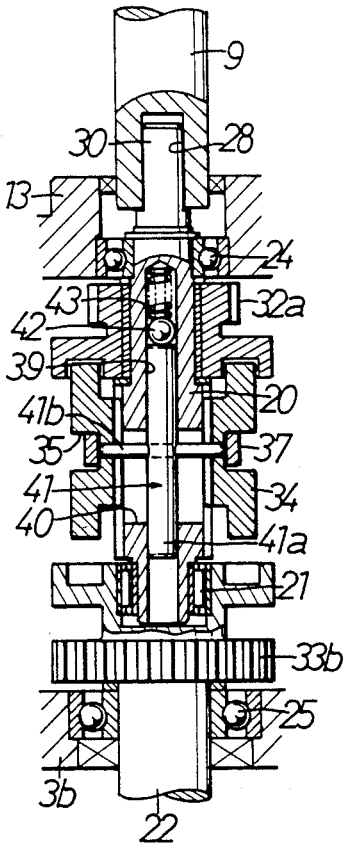
FIG. 3 is a sectional view taken along line III—III in FIG. 2.

Referring to FIGS. 2 and 3, the auxiliary case portion 3*b* is formed with a transmission chamber 12 containing the transmission 10. An open upper surface of the chamber 12 is normally closed by a lid 13 which is detachably secured to the auxiliary case portion 3*b* by a bolt 14.

The transmission 10 includes a primary shaft 20, a sub-shaft 22 rotatably fitted on the lower end of the primary shaft 20 through a needle bearing 21, and an intermediate shaft 23 disposed parallel to and on one side of both shafts 20 and 22. The primary shaft 20 is rotatably journaled in the lid 13 by ball bearings 24 and is drivingly connected to the drive shaft 9. The sub-shaft 22 is rotatably journaled in the auxiliary case portion 3*b* - by ball bearings 25 and is drivingly connected to the input shaft 11*a* of the gear assembly 11. The intermediate shaft 23 is rotatably journaled in the auxiliary case portion 3*b* and the lid 13 by respective plain bearings 26 and 27.

In this case, each of the connections between the drive shaft 9 and the primary shaft 20 and between the sub-shaft 22 and the input shaft 11*a* is provided by withdrawably fitting a connecting portion 30, 31 of arcuate section respectively formed on the upper end of primary shaft 20, and input shaft 11*a*, into an associated connecting hole 28 and 29 of corresponding arcuate section respectively provided in the lower end of upper shaft 9 and the lower end of sub-shaft 22. Moreover, the connecting holes 28 and 29 as well as the connecting portions 30 and 31 are of the same size and shape so that the connecting portion 31 of the input shaft 11*a* can be alternatively fitted into the connecting hole 28 in the drive shaft 9 in the second configuration shown in FIG. 4.

A first gear train 32 is provided adjacent the primary shaft 20 and the intermediate shaft 23, and a second gear train 33 is adjacent the intermediate shaft 23 and the sub-shaft 22. The first gear train 32 includes a drive gear 32*a* rotatably carried on the primary shaft 20 and a driven gear 32*b* fixedly mounted on the intermediate shaft 23. The second gear train 33 has a drive gear 33*a* fixedly mounted on the intermediate shaft 23 and a driven gear 33*b* rotatably carried on the sub-shaft 22. Between both the gear trains 32 and 33 is a dog clutch 34 which is slidably spline-connected on the primary shaft 20. The dog clutch 34 is adapted to come into driving engagement with the drive gear 32*a* of the first gear train 32 when it moves up and to come into drive engagement with the driven gear 33*b* of the second gear train 33 when it moves down.

The overall gear ratio of the first and second gear trains 32 and 33 is selected so that the sub-shaft 22 can be driven at reduced speed by the primary shaft 20 through both the gear trains 32 and 33.

A shift fork 37 is connected to a shift rod 36 which extends parallel to the primary and sub-shafts 20 and 22. The shift fork 37 is engaged in a groove in the outer periphery of the dog clutch 34. The shift rod 36 is slidably carried in the auxiliary case 3*b* and lid 13, and is connected to a shift lever 38 pivotably connected to the upper portion of the primary case portion 3*a*, as shown in FIG. 1. If the shift lever 38 is pivoted forwardly or rearwardly, the dog clutch 34 can be moved up or down through the shift rod 36 and the shift fork 37 moved to a position for engagement with the gear 32*a* or a position for engagement with the gear 33*b*.

The primary shaft 20 is provided with a central bore 39 (FIG. 3) passing through the central portion thereof and a transverse bore 40 extending perpendicularly to the central bore 39 and having axial extent in the direction of the primary shaft 20. A cross-shaped shaft 41 constituted by a lonitudinal shaft 41*a* and a transverse shaft 41*b* are fitted in the bores 39 and 40 for sliding movement in the axial direction of the primary shaft 20. The transverse shaft 41*b* is secured to the dog clutch 34, and a compression spring 43 in the central bore 39 urges the longitudinal shaft 41*a* downwardly through a ball 42. Additionally, a spring 44 is mounted on the shift rod 36 for biasing the shift rod 36 upwardly along with the shift fork 37. Consequently, both springs 43 and 44 cooperate to resiliently urge the dog clutch 34 and the shift fork 37 in the axial direction of the primary shaft 20, so that any free space between the dog clutch 34 and the shift fork 37 will be substantially eliminated.

The gear case 6 contains a water pump 45 driven from the input shaft 11*a* of the gear assembly 11. The water pump 45 draws ambient water, such as seawater through a suction port 46 in the rear portion of the gear case 6 and supplies the water to a water jacket of the engine 4 through a water line 47.

The water line 47 has an L-shaped discharge port 48 in the gear case 6, a vertical through hole 49 in the auxiliary case portion 3*b*, an auxiliary water pipe 51 having its opposite ends inserted respectively in the vertical leg of the discharge port 48 and the through hole 49, and a primary water pipe 50 extending downwardly from the water jacket of the engine 4 into the through hole 49. In this case, the primary and auxiliary water pipes 50 and 51 are of the same diameter, and the primary water pipe 50 is alternatively insertable into the vertical leg of the discharge port 48 when the auxiliary case portion 3*b* is omitted in the second configuration of the outboard engine construction as shown in FIG. 4.

The water which has circulated through the water jacket to cool the engine 4 flows through the interior of the extension case 3 along with the exhaust gases discharged from an exhaust pipe 52 and is discharged below the surface of the surrounding body of water through a discharge port 53 at the rear of the gear case 6.

The operation of the embodiment of the invention will now be described hereafter.

As shown in FIG. 1, if the primary and auxiliary case portions 3*a* and 3*b* are interconnected so that the auxiliary case portion 3*b* is connected to the gear case 6, the configuration of the outboard engine construction is such that the extension case 3 has a relatively long overall length. This outboard engine construction is effective for application to deep draft ship S. During operation of the engine 4, if the dog clutch 34 is moved up by operating the shift lever 38, as shown in FIG. 2 to bring the drive gear 32*a* of the first gear train 32 into engagement with the primary shaft 20, the drive rotation tramsitted from the crank shaft 8 through the drive shaft 9 to the primary shaft 20 is transmitted at reduced speed and high torque through the first gear train 32, the intermediate shaft 23 and the second gear train 33 to the sub-shaft 22 and then with a further step down through the gear assembly 11 to the propeller 5, so that the propeller 5 can be driven at a relatively low speed. Thus, if the power output of the engine 4 is moderately restricted, the navigation of the ship S at an extremely low speed can be assured. Conversely, if the dog clutch 34 is moved down to directly connect the primary shaft 20 to the sub-shaft 22, the rotation from the drive shaft 9 to the primary shaft 20 is directly transmitted to the sub-shaft 22 without speed reduction and then to the propeller 5 with speed reduction only through the gear assembly 11, so that the propeller 5 can be driven at a relatively higher speed. Thus, if the power output of the engine 4 is increased, the navigation of the ship at the increased speed can be assured.

Alternatively, if the auxiliary case portion 3*b* is removed and the primary case portion 3*a* is directly connected to the gear case 6, as shown in the second configuration of the outboard engine construction in FIG. 4, the outboard engine construction is of relatively short length and is effective for application to the shallow-draft ship S'.

In this arrangement, the shift rod 36 and the auxiliary water pipe 51 are removed along with the auxiliary case portion 3*b* , and the drive shaft 9 is directly connected to the input shaft 11*a* of the gear assembly 11, while the primary water pipe 50 is directly connected to the vertical leg of the discharge port 48. In addition, the change rod 16 is replaced by a shorter change rod 16'.

When the engine 4 is operated, the rotation of the drive shaft 9 is transmitted to the input shaft 11*a* of the gear assembly 11 without intermediate speed reduction so that the propeller 5 is driven at a relatively higher speed. Thus, if the power output of the engine 4 is increased, the navigation of the ship S' at an increased speed can be provided.

As seen from the above, according to the present invention, the extension case is constituted by the primary upper case portion 3*a* selectively permitting the extension cas to be connectable to the gear case 6 directly or through the intermediary of the auxiliary lower case portion 3*b* which is removably connectable to the primary case portion and the gear case. The transmission is contained in the auxiliary case portion 3*b* and is removably interposed therewith between the drive shaft and the gear assembly. Therefore, the use of the auxiliary case portion makes it possible to provide an outboard engine construction including the longer extension case and the transmission. On the other hand, if the auxiliary case portion 3*b* is removed and the primary case portion 3*a* is directly connected to the gear case 6, it is possible to provide an outboard engine including the shorter extension case. Accordingly, a single outboard engine construction can be freely adopted for use with ships of deep and shallow drafts, and the range of application thereof can be substantially widened. In addition, since one outboard engine construction can be made suitable for ships of deep and shallow drafts, most parts, excluding the auxiliary case portion, may be used in common. This enables the parts to be mass-produced and contributes to a reduction in cost.

Although the invention has been described in relation to a specific embodiment thereof, it will become apparent to those skilled in the art that numerous modifications and variations can be made within the scope and spirit of the invention as defined in the attached claims.

What is claimed is:

1. An outboard engine construction comprising an extension case including means for attachment to a vessel, an engine, a gear case connected to said extension case, a propeller rotatably supported by said gear case, a drive shaft coupled to said engine and extending in said extension case, a gear assembly in said gear case drivingly coupled to said drive shaft and to said propeller for transmitting drive from the drive shaft to the propeller, said extension case comprising a primary upper case portion and an auxiliary lower case portion, said auxiliary lower case portion being detachably connectable to said upper case portion and said gear case in a first configuration of the engine construction in which the extension case is of maximum length, said upper case portion being detachably connectable directly to said gear case with said lower case portion removed in a second configuration of the engine construction in which the extension case is of minimum length, and a transmission supported in said lower case portion and including means for detachable connection with said drive shaft and said gear assembly when said lower case portion is connected between the upper case portion and the gear case, said construction in said first configuration providing a first transmission path between the drive shaft and the gear assembly including said transmission whereas in said second configuration a second transmission path is provided directly between the drive shaft and the gear assembly without said transmission whereby in said first configuration the length of said extension case and the gear ratio of said first transmission path is adapted to a vessel of deep draft and in said second configuration the length of said extension case and the gear ratio of said second transmission path is adapted to a vessel of shallow draft said gear ratio of said first transmission path being different than said gear ratio of said second transmission path.

2. An outboard engine construction as claimed in claim 1 wherein said transmission means includes means for providing two gear ratios in said first transmission path, and selector means for selecting one of said two gear ratios.

3. An outboard engine construction as claimed in claim 2 wherein said selector means includes a displaceable member and an actuator means for displacing said displaceable member.

4. An outboard engine construction as claimed in claim 3 wherein said means which provides said two gear ratios further includes a primary shaft engaged for rotation with said drive shaft, a sub-shaft engaged for rotation with said gear assembly, and a gear train between said primary shaft and said sub-shaft, said displaceable member in said first configuration drivingly coupling said primary shaft and said sub-shaft via said gear train and in said second configuration drivingly connecting said primary shaft and said sub-shaft directly.

5. An outboard engine construction as claimed in claim 4 comprising means biassing said displaceable member to take up any space between the displaceable member and said actuator means.

6. An outboard engine construction as claimed in claim 5 wherein said displaceable member comprises a tubular dog clutch, a shift fork engaging said dog clutch to displace the same, and a shift rod engaging said fork, said biassing means comprising a spring-loaded shaft within said dog clutch engaging said fork and a biassing spring acting on said shift rod.

7. An outboard engine construction as claimed in claim 1 wherein said engine is mounted on said primary upper case portion, said drive shaft extending downwardly of the engine.

8. An outboard engine construction as claimed in claim 1 comprising means defining a path for water flow through said gear case and extension case to said engine in both said first and second configurations of said construction.

9. An outboard engine construction as claimed in claim 8 wherein said means which defines said path for water flow includes a water pipe in said primary upper case portion, a discharge port in said gear case and a through hole in said auxiliary lower case portion, said water pipe communicating directly with said discharge port in said second configuration and communicating with said discharge port via said through hole in said first configuration.

10. An outboard engine construction as claimed in claim 9 comprising a removable auxiliary water pipe connecting said through hole and said discharge port in said first configuration.

11. In an outboard engine construction having an engine, an extension case including means for attachment to a vessel, a gear case connected to the extension case and including a gear assembly, a propeller rotatably supported by the gear case and drivingly coupled to the gear assembly, and a drive shaft in said extension case drivingly connected to the engine, the improvement wherein said extension case includes a primary upper case portion and an auxiliary lower case portion, said auxiliary lower case portion being detachably connected to said primary upper case portion and to said gear case in a first configuration of the outboard engine construction, said primary upper case portion being detachably connected to said gear case, with said lower case portion removed, in a second configuration of the outboard engine construction, and a transmission supported in said lower case portion and including means for detachable connection with said drive shaft and said gear assembly in said first configuration, said drive shaft being directly connected to said gear assembly in said second configuration, said extension case having a length in said first configuration adapted to a vessel of deep draft and a lesser length in said second configuration adapted to a vessel of shallow draft, said transmission comprising means establishing two selectively operable drive paths between said drive shaft and said gear assembly, one of which paths has a step-down gear ratio.

12. An outboard engine construction as claimed in claim 11 comprising externally operated selector means for selecting said drive paths of said transmission.

13. An outboard engine construction as claimed in claim 12 said selector means includes a displaceable member and an actuator means for displacing said displaceable member.

14. An outboard engine construction as claimed in claim 13 wherein said means which establishes said two drive paths comprises a primary shaft engaged for rotation with said drive shaft, a sub-shaft engaged for rotation with said gear assembly, and a gear train between said primary shaft and said sub-shaft, said displaceable member in said first configuration drivingly coupling said primary shaft and said sub-shaft via said gear train and in said second configuration drivingly connecting said primary shaft and said sub-shaft directly.

15. An outboard engine construction as claimed in claim 14 comprising means biassing said displaceable member to take up any space between the displaceable member and said actuator means.

16. An outboard engine construction as claimed in claim 15 wherein said displaceable member comprises a tubular dog clutch, a shift fork engaging said dog clutch to displace the same, and a shift rod engaging said fork, said biassing means comprising a spring-loaded shaft within said dog clutch engaging said fork and a biassing spring acting on shift rod.

17. An outboard engine construction as claimed in claim 11 wherein said engine is mounted on said primary upper case portion, said drive shaft extending downwardly of the engine.

18. An outboard engine construction as claimed in claim 11 comprising means defining a path for water flow through said gear case and extension case to said engine in both said first and second configurations of said construction.

19. An outboard engine construction as claimed in claim 18 wherein said means which defines said path for water flow includes a water pipe in said primary upper case portion, a discharge port in said gear case and a through hole in said auxiliary lower case portion, said water pipe communicating directly with said discharge port in said second configuration and communicating with said discharge port via said through hole in said first configuration.

20. An outboard engine construction as claimed in claim 19 comprising a removable auxiliary water pipe connecting said through hole and said discharge port in said first configuration.

21. In an outboard engine construction having an engine, an extension case including means for attachment to a vessel, a gear case connected to the extension case and including a gear assembly, a propeller rotatably supported by the gear case and drivingly coupled to the gear assembly, and a drive shaft in said extension case drivingly connected to the engine, the improvement wherein said extension case includes a primary upper case portion and an auxiliary lower case portion, said auxiliary lower case portion being detachably connected to said primary upper case portion and to said gear case in a first configuration of the outboard engine construction, said primary upper case portion being detachably connected to said gear case, with said lower case portion removed, in a second configuration of the outboard engine construction, and a transmission supported in said lower case portion and including means for detachable connection with said drive shaft and said gear assembly in said first configuration, said drive shaft being directly connected to said gear assembly in said second configuration, said extension case having a length in said first configuration adapted to a vessel of deep draft and a lesser length in said second configuration adapted to a vessel of shallow draft, said transmission including gears providing a drive state with a step-down gear ratio to reduce speed.

22. An outboard engine construction as claimed in claim 21 wherein said engine is mounted on said primary upper case portion, said drive shaft extending downwardly of the engine.

23. An outboard engine construction as claimed in claim 21 comprising means defining a path for water flow through said gear case and extension case to said engine in both said first and second configurations of said construction.

24. An outboard engine construction as claimed in claim 23 wherein said means which defines said path for water flow includes a water pipe in said primary upper case portion, a discharge port in said gear case and a through hole in said auxiliary lower case portion, said water pipe communicating directly with said discharge port in said second configuration and communicating with said discharge port via said through hole in said first configuration.

25. An outboard engine construction as claimed in claim 24 comprising a removable auxiliary water pipe connecting said through hole and said discharge port in said first configuration.

* * * * *